United States Patent [19]

Thompson

[11] 4,128,862

[45] Dec. 5, 1978

[54] LAMP MOUNTING

[75] Inventor: Harold R. Thompson, Sierra Madre, Calif.

[73] Assignee: Soderberg Manufacturing Co., Inc., Walnut, Calif.

[21] Appl. No.: 718,902

[22] Filed: Aug. 30, 1976

[51] Int. Cl.[2] ..... H05B 33/02; F21V 21/00; H01R 33/08

[52] U.S. Cl. ..... 362/217; 339/50 R; 339/56; 362/396

[58] Field of Search ..... 339/50 R, 52 R, 52 S, 339/54, 56; 362/396; 337/190, 195, 198

[56] References Cited

U.S. PATENT DOCUMENTS 3,836,939 9/1974 Barre et al. ..... 339/56

3,906,217 9/1975 Lackore ..... 362/396

*Primary Examiner*—R. N. Envall, Jr.

*Attorney, Agent, or Firm*—Warren, Chickering & Grunewald

[57] ABSTRACT

A lamp mounting having a terminal post providing a rest surface for one side of a lamp terminal of normally regular rectangular shape and a clamping member formed for engagement with the opposite side of the lamp terminal for clamping the latter onto the post and a link pivoted to the post and clamping member, and means applying a resilient force to the link for tightening the clamping member onto the lamp terminal and providing a resiliently yieldable engagement of the lamp terminal between the terminal post and clamping member.

11 Claims, 4 Drawing Figures

LAMP MOUNTING

BACKGROUND OF THE INVENTION

1. Field of Invention

The present invention is designed for use with quartz-halogen cycle incandescent lamps as installed in lamp fixtures subject to vibration and high heat, such as on airplanes and the like.

2. Description of Prior Art

The quartz-halogen lamp comprises an elongated glass bulb or envelope and rectangular terminals mounted on the opposite ends of the bulb, and which in perfectly formed lamps, have their central longitudinal axes coincident with the central longitudinal axis of the bulb. Moreover, in perfectly formed bulbs, the rectangular sides of the terminals will be parallel to the common central axis, with the sides of one terminal parallel to the sides of the other. Due to manufacturing variations, however, perfectly formed lamps are uncommon, and the lamp holder is required to contend with lamp terminals which are skewed and nonparallel, either to each other or to the central axis of the lamp. Consequently, when such imperfect lamps are clamped in prior lamp holders, frequent and premature breakage of the fragile quartz envelope results.

Another problem encountered in the use of quartz-halogen lamps is the generation of intense localized heat, which, in combination with other strains placed on the lamp as above discussed and the severe vibration to which these lamps are subjected, leads to premature failure of the lamps.

SUMMARY OF THE INVENTION

An object of the present invention is to provide a lamp mounting of the character described which will afford an automatic self-positioning of skewed or otherwise imperfectly formed lamp terminals, thus enabling the required clamping of the lamp terminals onto the terminal posts of the lamp holder so as to assure excellent electrical contact without imparting undue strain on the quartz envelope.

Another object of the present invention is to provide a lamp mounting of the character above which will secure the lamp terminal in a vibration-tolerant support.

A further object of the present invention is to provide a lamp mounting of the character described which will effect a rapid dissipation of heat, thus co-functioning with the other features of the present invention in obtaining significantly increased lamp life.

The invention possesses other objects and features of advantage, some of which of the foregoing will be set forth in the following description of the preferred form of the invention which is illustrated in the drawings accompanying and forming part of this specification. It is to be understood, however, that variations in the showing made by the said drawings and description may be adopted within the scope of the invention as set forth in the claims.

DETAILED DESCRIPTION OF INVENTION

Figure 1:
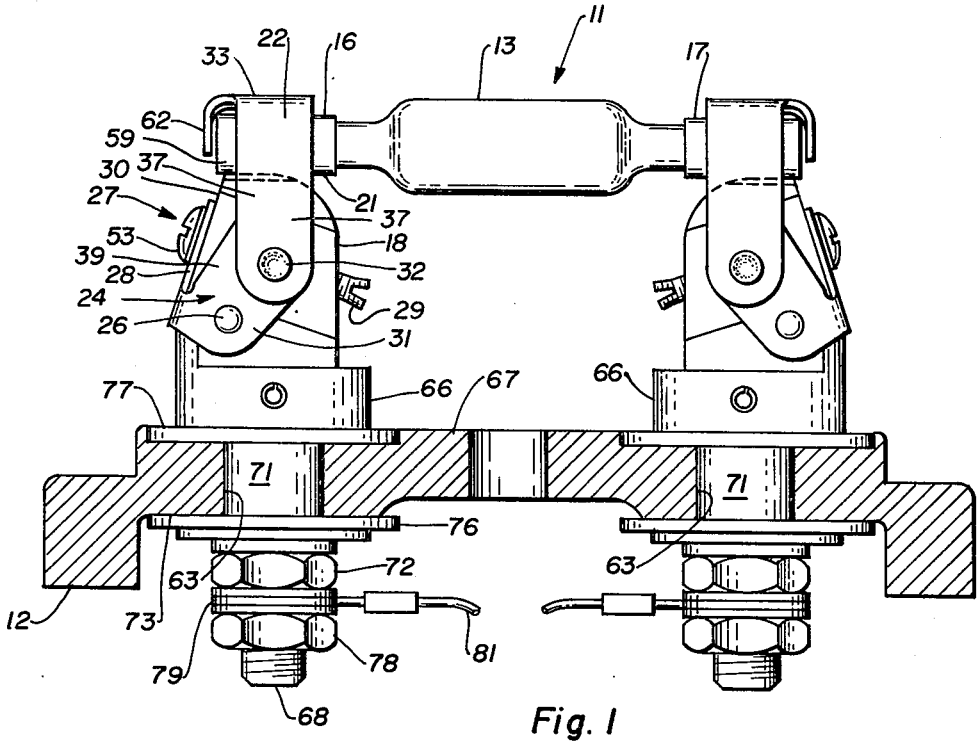
FIG. 1 is a side elevation of a lamp holder constructed in accordance with the present invention.
Figure 2:
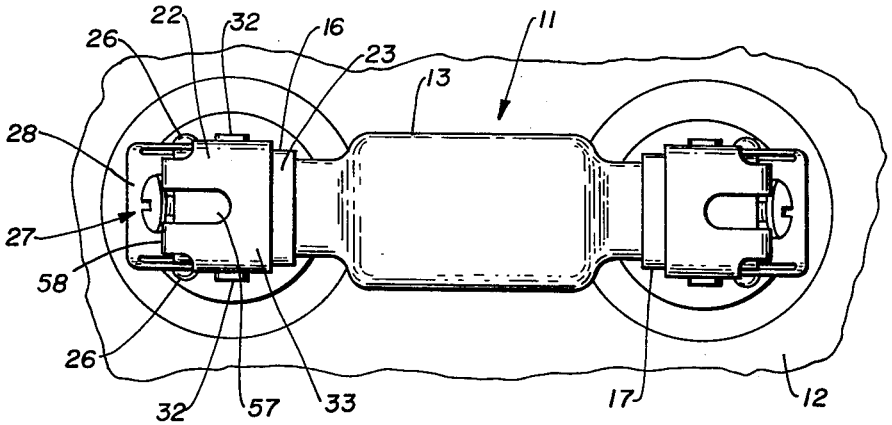
FIG. 2 is a top plan view of the lamp holder.

A typical aircraft wingtip light is illustrated in FIGS. 1 and 2 of the drawing and uses a quartz-halogen lamp 11, which is supported on a base plate 12, forming part of the lamp supporting and housing structure. Lamp 11 comprises, generally, an elongated quartz bulb or envelope 13 and electrical terminals 16 and 17, which extend longitudinally from the opposite ends of the quartz envelope and are engaged in the connectors of the present invention. Two such connectors are thus required. They are, here, of identical construction and mounting so that a detailed description of one will suffice for both.

Each of the lamp mountings of the present invention comprises, briefly, a terminal post 18 providing a rest surface 19 for one side 21 of a lamp terminal 16–17, a clamping member 22 formed for engagement with the opposite side 23 of the lamp terminal for clamping the latter to post surface 19, a link 24 pivoted, as by pin 26, to post 18 and by pivot pin 32 to clamping member 22, and means 27 adjusting the rotative position of link 24 relative to post 18 to control the clamping pressure on the lamp terminal, means 27 including a resilient arm 28 mounted on link 24 and providing the link connection to means 27 and providing a resiliently yieldable compression of the lamp terminal 16–17 between post surface 19 and clamping member 22. As will be observed, arm 28 here comprises a flat leaf spring connected at one end to link 24, and means 27 comprises a manually engageable screw 29 mounted in engagement with the other, free end 44 of spring 28 and threadably attached to post 18 for flexing of the spring toward post side 30 and establishing a yieldable compression of terminal 16 between post surface 19 and clamping member 22. Link 24 and arm 28 comprise, in effect, a bell crank having one leg 31 with spaced pivotal connections 26 and 32 to post 18 and clamping member 22 respectively, and a second leg comprising leaf spring 28 connected to screw 29.

Figure 4:
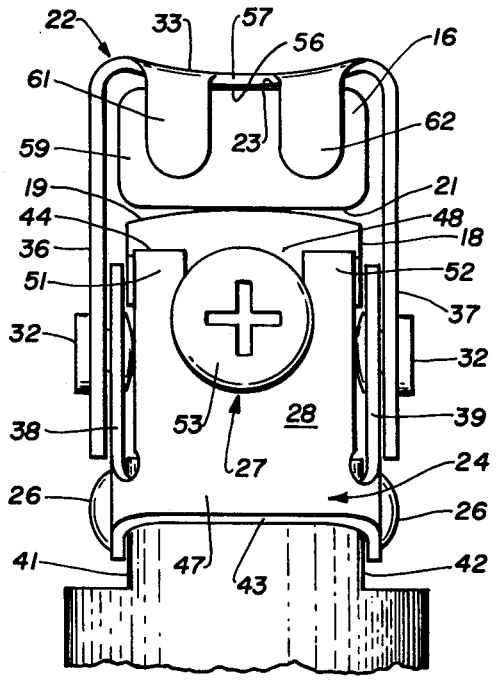
FIG. 4 is a fragmentary rear elevation of the portion of the lamp holder illustrated in FIG. 3.

As will be best seen from FIG. 4, clamping member 22 is here formed as a substantially inverted U-shaped member with a connecting portion 33 overlying post surface 19 for engagement with the lamp terminal and a pair of depending legs 36 and 37 mounted on opposite sides of post 18 in straddling relation thereto. In cooperation with this double-sided structure of the clamping member, link 24, as viewed in FIG. 4, comprises a pair of levers 38 and 39, each forming one leg 31 of the above-described bell crank, pivoted by pins 26 to the opposite sides 41 and 42 of post 18 and having spaced pivotal connections 32 to the lower ends of legs 36 and 37. Spring arm 28 is formed as a free-standing wall connected at its lower end 43 to levers 38 and 39 in spaced relation to the post lever pivots 26 and on the ends of levers 38 and 39 opposite to the lever leg pivots 32, the free-standing spring wall extending longitudinally of the terminal post to side 30 thereof and being connected at its opposite (upper) end 44 to screw 29. As will be best observed from FIG. 1, tightening of the screw will cause a flexing of the leaf spring arm toward the terminal post side 30 and a clockwise rotation of the bell crank link member 24, thus drawing downwardly on the lower ends of legs 36 and 37 of the clamping member and producing a resilient downward force of the connection portion 33 of the clamping member against the top side 23 of lamp terminal 16. Preferably, and as here shown in FIG. 4, the bell crank link and arm structure is composed of a one-piece U-shaped member of spring metal with spaced-apart, substantially parallel sides defining levers 38 and 39 and a connecting portion 47 defining the lower end of the free-standing spring wall 28. As will be observed, the leaf spring wall is formed to extend divergently upwardly in spaced relation to levers 38 and 39.

As will also be best seen from FIG. 4, the upper end 44 of the leaf spring member is formed with a medial recess 48 opening to the upper end of the wall to define a pair of spaced-apart spring leaf sections 51 and 52; and screw 29 is mounted in recess 48 and is formed with a head 53 engaged with the exterior side of sections 51 and 52, whereupon turning of the screw into the post will be accompanied by a flexing of the spring sections towards the post.

Figure 3:
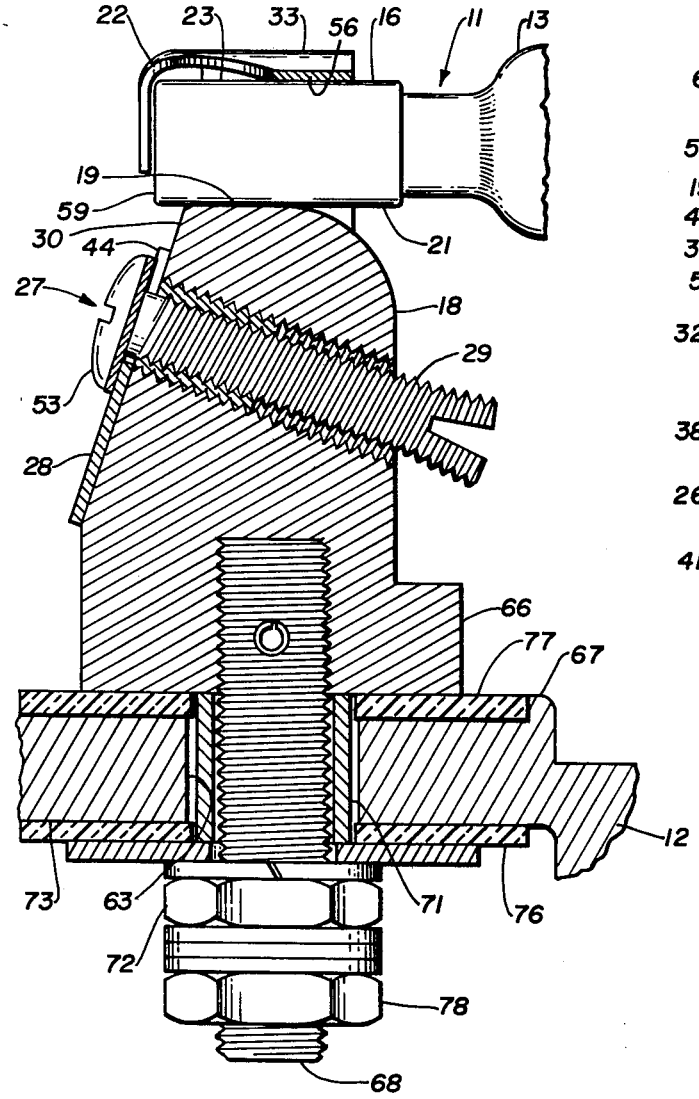
FIG. 3 is a cross-sectional view on an enlarged scale of a portion of the lamp holder, the view being taken substantially on the plane of line 3—3 on FIG. 2.

As an important feature of the present invention, the terminal post rest surface 19 is formed to provide a substantially tortion-free contact with malformed lamp terminals. As hereinabove noted, the terminals 16 and 17 of the standard quartz-halogen lamp 11 are of elongated form rectangular in cross-section with the central axis of the terminals coincident with the central longitudinal axis of the quartz envelope. In a perfectly formed lamp, the flat bottom surfaces 21 of the lamp terminals will lie in a common plane parallel to the common longitudinal axis of the lamp, and the top surfaces 23 of the two terminals will lie in a common plane parallel to the bottom surfaces 21. It is exceedingly difficult in the manufacture of these lamps to hold tight tolerances on these critical lamp terminal surfaces, and, commonly, these surfaces are skewed so that they are not parallel to each other and to the longitudinal axis of the lamp. To meet this common condition, and as an important feature of the present invention, terminal post rest surface 19 is curved in planes substantially parallel to and transverse to the post side walls 41 and 42, thus providing a compound curve in relation to the longitudinal axis of the lamp and a substantially tortion-free contact with skewed, misaligned lamp terminals. As will be best observed from FIG. 3, surface 19 is upwardly convexly curved in a vertical axially extending plane; and as will be best observed from FIG. 4, surface 19 is upwardly convexly curved in a transverse plane perpendicular to the longitudinal axis of the lamp and also perpendicular to post sides 41 and 42. As a result, the bottom surface 21 of the lamp terminal will automatically self-orient to a point or line contact with post surface 19, thereby permitting the application of substantial electrical contacting force without imparting any tortional strain on the lamp terminal and the quartz envelope.

Preferably, and as will be best seen from FIG. 4, connecting portion 33 of clamping member 22 comprises a resilient concavo-convex wall when viewed in a transverse plane, with its convex side 56 confronting rest surface 19 so as to engage the upper surface 23 of the lamp terminal in a substantially line contact best co-functioning with the compound curve of surface 19 to remove tortional strain on the lamp terminal. Also, preferably wall 33 is formed with a medial recess 57, see FIG. 2, opening to an end 58 of the wall juxtaposed to the end 59 of terminal 16 to accommodate the usual center protrusion (not shown) on terminal 16; and is formed with depending fingers 61 and 62 on opposite sides of recess 57, dimensioned for engaging lamp terminal end 59 and confining the lamp terminal within the confines of the clamping member.

The quartz-halogen lamp 11 generates intense luminosity attended by substantial heat, which must be rapidly conducted away from the lamp if good lamp life is to be achieved. In the present structure, the pressurized lamp terminal connections provide good heat conduction to the terminal posts, as well as good electrical connections. Advantage is taken of this heat conduction to rapidly dissipate the intense generated heat by conducting it through the post to wall 12 of the lamp structure. As here shown, wall 12 comprises a relatively thick metal section which will function in conjunction with its connected structure as a heat sump for rapidly conducting heat away from the lamp. As will be best seen from FIGS. 1 and 3, wall 12 is formed with openings 63 for receiving therethrough the two terminal posts of the lamp mounting. Each terminal post 18 is formed with a base 66 adapted for mounting on the top surface 67 of wall 12 and is fitted with a stud 68 extending axially from base 66 and dimensioned for extension through opening 63. A sleeve 71 of electrical insulation material is mounted on stud 68 in opening 63 and electrically insulates the stud and post from plate 12. A nut 72 is threaded on the lower end of stud 68 for engaging the underside 73 of wall 12 for clamping the stud and terminal post in place; and, importantly, electrically insulating heat-conducting spacer means 76 and 77 are mounted between base 66 and the upper side 67 of wall 12 and between nut 72 and the underside 73 of wall 12. Heat generated in the lamp is thus rapidly conducted through the terminal post and to wall 12. Spacer means 76 and 77 may, and here preferably, comprise beryllium oxide washers. A second nut 78 is here threaded onto stud 68 for clamping against nut 72 the terminal end 79 of an electrical conductor 81, thus establishing electrical contact to the terminal post and lamp terminal 16.

What is claimed is:

1. In a lamp mounting having a terminal post providing a rest surface for one side of a lamp terminal and a clamping member formed for engagement with the opposite side of said lamp terminal for clamping the latter to said post surface and a link pivoted to said post and member and means adjusting the rotative position of said link relative to said post to control the clamping pressure on said lamp terminal, the improvement comprising:

a resilient arm mounted on said link and providing the link connection to said means for providing a resiliently yieldable compression of said lamp terminal between said post surface and member.

2. A lamp mounting as defined in claim 1, said arm comprising a leaf spring connected at one end to said link; and said means comprising a manually engageable screw mounted in engagement with the other end of said spring and threadably attached to said post for flexing said spring and providing said yieldable compression.

3. A lamp mounting as defined in claim 1, said link and arm comprising a bell crank having one leg with spaced pivotal connections to said post and clamping member and a second leg comprising a leaf spring connected to said means.

4. A lamp mounting as defined in claim 1, said clamping member being of substantially inverted U-shape with a connecting portion overlying said post surface for engagement with said lamp terminal and a pair of depending legs mounted on opposite sides of said post in straddling relation thereto;

said link and arm comprising a pair of levers pivoted to said opposite post sides and having spaced pivotal connections to said legs; and an integrally formed free-standing wall connected at one end to said levers at ends thereof spaced from the post lever pivots and on the ends of said levers opposite to the lever leg pivots, said wall extending longitudinally of said post in spaced relation thereto and connected at its opposite end to said means and being formed of resilient material to provide said yieldable compression of said lamp terminal.

5. A lamp mounting as defined in claim 4, said link and arm comprising a one-piece U-shaped second member of spring metal with spaced apart substantially parallel sides defining said levers and a connecting portion defining said one end of said wall, said wall extending from said one end in spaced relation to said second member sides.

6. A lamp mounting as defined in claim 5, said wall being formed with a recess opening to the end of said wall opposite to said connecting portion to define a pair of leaf spring sections; and said means comprising a screw mounted in said recess and having one end threaded into said post and a head engaged with said sections.

7. A lamp mounting as defined in claim 1, said rest surface being formed to provide a substantially torsion-free contact with a malformed lamp terminal.

8. A lamp mounting as defined in claim 4, said rest surface being curved in planes substantially parallel to and transverse to said post sides to provide a substantially torsion-free contact with a malformed lamp terminal.

9. A lamp mounting as defined in claim 8, said clamping member connecting portion comprising a resilient concavo-convex wall, the curvature being viewed in a plane perpendicular to said post sides, and with its convex side confronting said rest surface, said wall being formed with a medial recess opening to an edge of said wall juxtaposed to an end of said lamp terminal and being formed with depending fingers on opposite sides of said recess dimensioned for engaging said lamp terminal end and confining said lamp terminal within the confines of said clamping member. .

10. A lamp mounting as defined in claim 7, adapted for mounting on a metal heat conducting wall having an opening therethrough;

said terminal post having a base adapted for mounting on one surface of said wall and a stud extending from said base and dimensioned for extension through said opening;

a sleeve of electrical insulation material surrounding said stud in said opening and electrically insulating said stud from said wall;

means on said stud for engaging the opposite side of said wall for securing said lamp mounting; and electrically insulating heat conducting spacer means mounted between said base and wall and between said first-named means and said wall.

11. A lamp mounting as defined in claim 10, said last-named means comprising beryllium oxide washers.

* * * * *

UNITED STATES PATENT AND TRADEMARK OFFICE

CERTIFICATE OF CORRECTION

PATENT NO. : 4,128,862

DATED : December 5, 1978

INVENTOR(S) : Harold R. Thompson

It is certified that error appears in the above-identified patent and that said Letters Patent are hereby corrected as shown below:

Column 2, line 58, after "post" insert ---in spaced relation---.

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*